US007513976B2

(12) United States Patent
Freti et al.

(10) Patent No.: US 7,513,976 B2
(45) Date of Patent: Apr. 7, 2009

(54) MATERIALS FOR DEWATERING ELEMENTS

(75) Inventors: Silvano Freti, St. Prex (CH); Lothar Burchardt, Valeyres-sous-Rances (CH); Günter Bellmann, Commugny (CH)

(73) Assignee: BTG Eclepens, S.A., Eclepens (CH)

( * ) Notice: Subject to any disclaimer, the term of this patent is extended or adjusted under 35 U.S.C. 154(b) by 373 days.

(21) Appl. No.: 10/578,880

(22) PCT Filed: Nov. 17, 2004

(86) PCT No.: PCT/EP2004/012999

§ 371 (c)(1),
(2), (4) Date: Jun. 8, 2006

(87) PCT Pub. No.: WO2005/054574

PCT Pub. Date: Jun. 16, 2005

(65) Prior Publication Data

US 2007/0068646 A1 Mar. 29, 2007

(30) Foreign Application Priority Data

Nov. 20, 2003 (SE) ..... 0303073

(51) Int. Cl.
*D21F 1/48* (2006.01)

(52) U.S. Cl. ..... 162/374; 162/352

(58) Field of Classification Search ..... 162/211, 162/217, 351, 352, 363, 364, 366, 374
See application file for complete search history.

(56) References Cited

U.S. PATENT DOCUMENTS

| | | | | | |
|---|---|---|---|---|---|
| 3,194,729 | A | * | 7/1965 | Robinson | 162/374 |
| 3,337,394 | A | * | 8/1967 | White et al. | 162/352 |
| 3,975,568 | A | * | 8/1976 | Rudness | 428/329 |
| 4,306,053 | A | * | 12/1981 | Harrison et al. | 528/77 |
| 5,096,993 | A | * | 3/1992 | Smith et al. | 528/61 |

FOREIGN PATENT DOCUMENTS

| | | | |
|---|---|---|---|
| EP | 0 576 115 | A1 | 12/1993 |
| GB | 1 526 377 | | 9/1978 |
| WO | WO 97/30212 | A1 | 8/1997 |
| WO | WO 00/48747 | A1 | 8/2000 |

* cited by examiner

*Primary Examiner*—Eric Hug
(74) *Attorney, Agent, or Firm*—Buchanan Ingersoll & Rooney PC

(57) ABSTRACT

A material for dewatering elements at the wet end of a paper-making machine is disclosed. The material comprises an elastomeric polymer matrix, and a filler added to the matrix at a level of 10 to 50 percent by weight, and the material has a hardness according to Shore A between 60 and 85. The invention also relates to a dewatering element comprising such material, and to the use of such material for the preparation of a dewatering element.

20 Claims, 2 Drawing Sheets

MATERIALS FOR DEWATERING ELEMENTS

TECHNICAL FIELD OF THE INVENTION

The present invention relates to materials for dewatering elements at the wet end of paper-making machines, to dewatering elements prepared with such materials, to the use of such materials for the preparation of dewatering elements, and to a method for producing such material.

TECHNICAL BACKGROUND OF THE INVENTION

In the wet end of a paper-making machine a forming screen or wire, supporting a slurry of cellulose fibers in water together with chemicals and pigments, slides over a number of dewatering elements which promote drainage of water from the slurry. Such dewatering elements include a forming board, foil blades, vacuum blades, suction box covers etc. The effluent water removed from the slurry through the forming screen typically contains about 0.5 to 1 percent of solid material. This solid material typically includes about 95 percent pigments (e.g. calcium carbonate) and about 5 percent cellulose fibers.

Hence, the forming screen sliding over these dewatering elements is subjected to extensive wear resulting from the sliding itself and from the presence of these pigments and cellulose fibers in the effluents. The forming screen, generally a polyester fabric, therefore has to be replaced for example every 30-35 days at a very high cost. Wear on the forming screen is particularly pronounced when the screen slides over the flat suction box covers, at which point the amount of effluent water has already been significantly reduced. Flat suction box covers are usually made of very hard ceramic materials, such as aluminum oxides, chromium oxides, zirconium oxides, silicon carbide or silicon nitride. The nature of such materials, including their surface roughness, porosity and pore size plays an important role in the wear of the forming screen, to a similar extent as the type and characteristics of the pigment in the water effluents (see for example M. Laufmann and H. U. Rapp, Wochenblatt für Papierfabrikation, 114/16, 615-622 (1986)).

The hard ceramic covers are vulnerable as they are subjected to accidental impact damage, stress cracking, thermal shock damage and sharpening under screen contact. Typically, their manufacturing costs are also very high as they consist of an assembly of small, 30 to 60 mm long individual elements which are glued together on the flat suction box, leaving small voids where pigment particles from the water effluent can accumulate. The retention of these pigment particles further accelerates the wear of the forming screen or wire.

Hence, there is a problem in the prior art relating to the wear on the forming screen at the wet end of paper-making machines due to the sliding of the screen over dewatering elements, and the associated high cost of the screen replacement. Moreover, there is a problem related to the vulnerability of the prior art ceramic materials.

GB 1 526 377 discloses dewatering elements having inserts made from polyurethane cast in situ and which are subsequently machined to the desired final shape. The preferred polyurethanes for use according to said patent are referred to-as having excellent hardness and abrasion properties, where the polyurethane has hardness values preferably in the range 93 Shore A to 96 Shore A. Minor amounts of fillers may be added to the polyurethane. As an example, the polyurethane "Adiprene L 167" is mentioned, which is a composition having a hardness of 95 Shore A. A small amount of green pigment is added to the composition.

SUMMARY OF THE INVENTION

It is an object of the present invention to alleviate the above-mentioned problems relating to wear and friction between the forming screen and the dewatering elements in a paper-making machine, and to the vulnerability of prior art ceramic materials.

This object is met by a material for dewatering elements as defined in the appended claims, by a dewatering element comprising this material, and by the use of this material for the preparation of a dewatering element.

It has now been found that the filler content of the material plays an important role in terms of the friction between the dewatering element and the forming screen. It was also found that a softer material for the dewatering elements generally lead to lower wear on the forming screen. The surprising effect noticed by the inventors was that a low hardness elastomeric matrix (such as a low hardness polyurethane) containing also a low hardness filler produced superior performance both in terms of low wear on the forming screen, and in terms of low friction between the dewatering elements and the forming screen.

However, it is known in the art that the addition of fillers to an elastomeric matrix will generally lead to an increase of the hardness of the material. Therefore, in order to obtain a finished product having a sufficiently low hardness, the present invention proposes to use an elastomeric polymer matrix of very low hardness values, to which friction-reducing fillers are added. The matrix (without any filler) used according to the present invention suitably has a nominal hardness value of 60 Shore A to 80 Shore A, providing a hardness for the final product of 60 to 85 Shore A depending on the type of filler added.

The present invention is based on a recognition that the problems of the prior art can be alleviated by the use of a soft material or cover for the dewatering elements, which nevertheless contains a comparatively high amount of filler.

Hence, the present invention provides a soft, non-porous material for dewatering elements, which material is designed to minimize the wear of the forming screen, and which does not present the vulnerability of prior art ceramic cover materials, nor their manufacturing drawbacks.

The material according to the invention can be prepared as one or several continuous void-free elements, thus completely eliminating the need in the prior art for a multitude of small elements glued together on a base substrate.

Surprisingly, the use of soft elastomeric materials for the dewatering elements has been found to produce less wear on the forming screen sliding over these dewatering elements than the conventionally used hard ceramic materials of, for example, aluminum oxide or silicon carbide. The reduction in wear is particularly pronounced when the soft material is used in conjunction with a filler, preferably a low hardness filler, to reduce the friction coefficient against the sliding screen.

According to the present invention, a material for a dewatering element is provided which comprises an elastomeric polymer matrix and a substantial amount of filler added to said matrix at a level of up to 50 percent by weight, such as 10 to 50 percent by weight, wherein the material has a hardness according to Shore A between 60 and 85.

The filler is preferably added at a level of 10 to 40 percent by weight, more preferably at a level of 15 to 30 percent by weight.

In a method for producing the material according to the present invention, a filler is added at a content of 10-50 percent by weight to an elastomeric polymer matrix, preferably a polyurethane matrix, having a matrix hardness (i.e. the hardness that would be obtained if no filler is added) of Shore A 60-80. The composition is then cured to produce the finished material, which has a hardness (now containing the filler) of Shore A 60-85. Hence, the addition of the filler will typically lead to an increase of the hardness of the cured material.

The elastomeric polymer matrix preferably comprises polyurethane (PUR). Other suitable materials for the polymer matrix include polyurea, styrene-butadiene rubber, ethylene propylene diene monomer (EPDM), nitrile rubber, natural or synthetic rubbers, polychloroprene, polyacrylates, fluorine-containing elastomers, thermoplastic elastomers and polysiloxanes. The selected elastomeric polymer matrix should have a nominal hardness of 60 Shore A to 80 Shore A when no filler is added.

The filler is preferably a low hardness and/or solid lubricant filler such as poly(tetrafluoroethylene) (PTFE) or talcum. Other suitable materials for the filler include powders of ultra high molecular weight polyethylene (UHMWPE), clay (kaolin), calcium carbonate, boron nitride, molybdenum sulfide, calcium fluoride, titanium dioxide, titanium carbide, spherical glass or ceramic beads.

By "low hardness filler", it is here meant a filler having a hardness on Moh's scale between 1 and 5. On the Moh's scale, diamond has a value of 10 and talc has a value of 1. For example, calcium fluoride has a value on Moh's scale of 4, calcium carbonate a value between 3 and 4, clay (kaolin) a value of 1.5-2, and molybdenum disulfide a value of 1.5-2.

The filler can be added to the elastomeric matrix using conventional dispersing or compounding techniques well known to those skilled in the art. For reasons of brevity, the preparation of the material will therefore not be described in greater detail in this specification.

DETAILED DESCRIPTION OF THE INVENTION

In the following, the invention will be described in more detail by means of a number of examples. The examples are better understood when taken in conjunction with the drawings, on which:

Like references are used throughout the drawings.

EXAMPLES

In the following, some examples of materials according to the present invention will be given. It should be noted that the examples are given for illustrative purposes only, and that the scope of the invention is defined by the claims.

Figure 1:
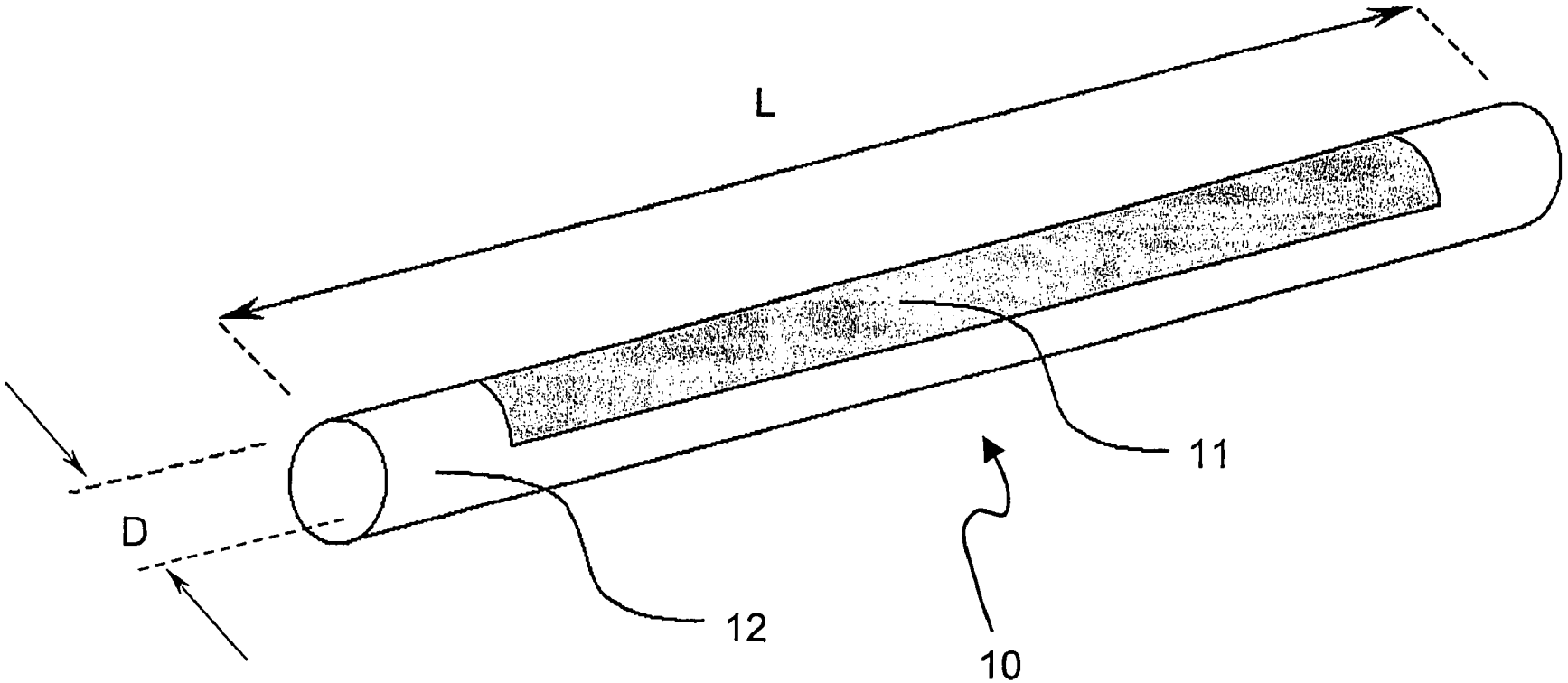
FIG. 1 shows one test element used in the examples.
Figure 2:
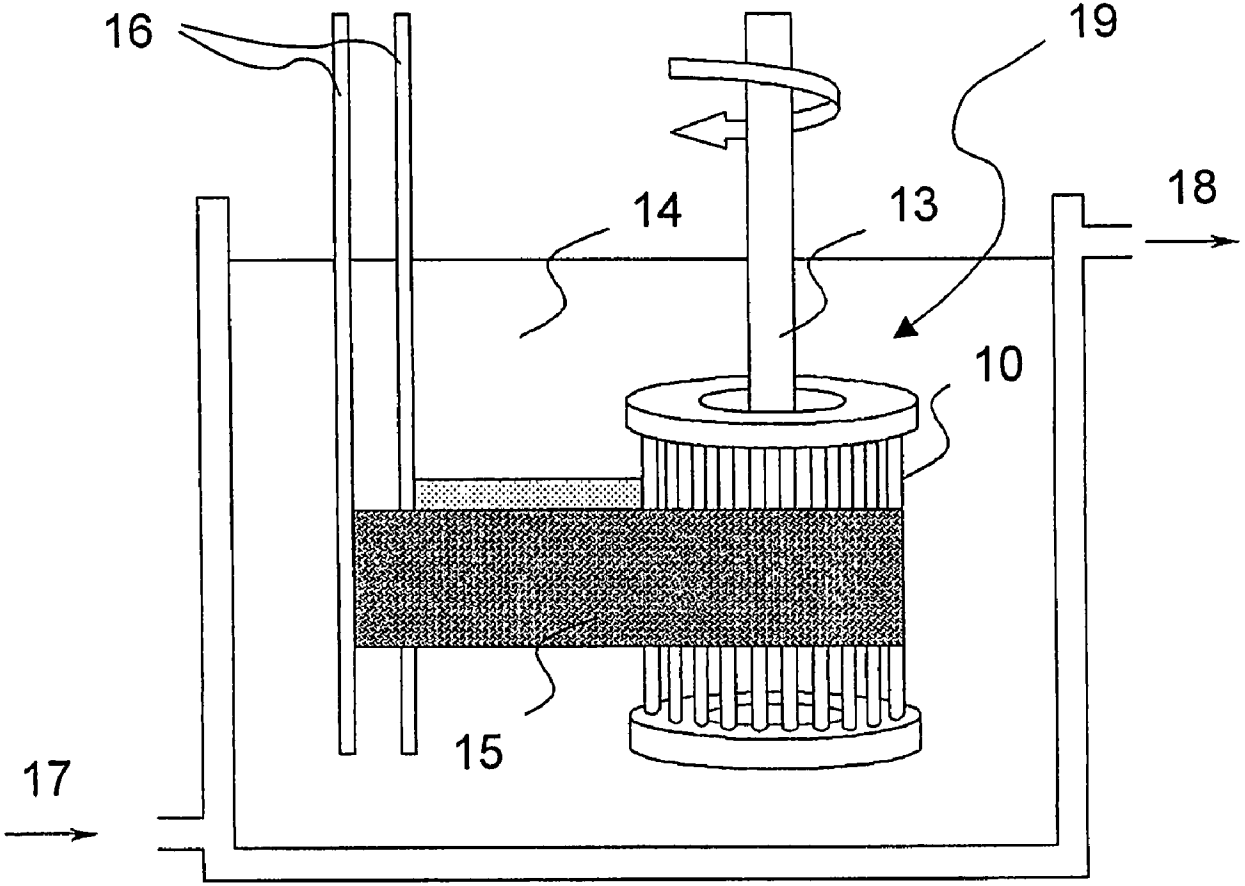
FIG. 2 shows the test set-up used in the examples.

Referring first to FIG. 1, a test element 10 used in the examples is shown. The test element comprises a cylindrical supporting element 12 of stainless steel, which is provided with an elastomeric cover material 11 according to the present invention. Each test element has a length L=72 mm and a diameter D=5 mm. To test the material according to this invention, a number of like elements 10 were assembled into a test body 19, as indicated in FIG. 2.

The examples show materials for dewatering elements, which are designed to minimize the wear on the forming screen, the latter typically being a polyester fabric. For testing the wear characteristics, a dedicated abrasion tester AT 2000 (Einlehner, Kissing, Germany) was employed. This tester simulates the wear on the forming screen with the presence of a standard pigment slurry.

The operating conditions for the AT 2000 test procedure will first be explained in detail with reference to FIG. 2. The test set-up comprises a container or bath filled with an aqueous pigment slurry 14. The pigment concentration in the slurry is between 0.8 and 3.2% in the experiments described below. The walls of the container have channels for cooling fluid (water) for keeping the temperature of the aqueous slurry below 30° C. To this end, the walls of the container have an inlet 17 and an outlet 18 for cooling water. A number (typically sixteen) of test elements 10 according to FIG. 1 are assembled into a test body 19 having a generally cylindrical overall shape. This test body is supported on a rotation shaft 13. The presence of a forming screen is simulated by a polyester screen 15 wrapped around the test body 19 and attached to two bars 16 for applying a force between the test body and the polyester screen. The elastomeric cover material 11 according to the present invention provided on each test element 10 is faced radially outwards of the test body 19, for contact with the polyester screen 15. The test body has an overall diameter of 31.8 mm and the polyester screen test samples have the size 148 mm×26 mm. The polyester screen is wrapped around half of the circumference of the test body; hence, the wear surface between the test body and the polyester screen is 50 mm×26 mm=1300 $mm^2$. For testing the wear on the forming screen caused by the test body, the rotation shaft 13 is rotated to give a linear relative speed between the polyester screen 15 and the test body 19 of 333 m/min at a contact force between them of 2 kg. The test is run for 75 min, corresponding to a test distance of about 25000 m.

The test set-up described above is used for all examples below, and is referred to as the standard AT 2000 test procedure.

Example 1

This example relates to the preparation and testing of a test body comprised of a PTFE-filled (poly(tetra-fluoroethylene)) cast polyurethane (PUR) matrix.

To prepare the material, 128.6 g of PTFE powder ("Zonyl MP 1200", from DuPont) was dispersed at room temperature in 300 g of a polyol ("Hyperplast 2851024", from Hyperplast). An amount of 63.93 g of this dispersion was degassed and mixed with 43.61 g of degassed prepolymer ("Hyperplast100") and 2.35 g of chain extender 1,4-butanediol (Merck) for two minutes, and then molded into sixteen elements 10 (one of which is detailed in FIG. 1) using a silicone mold and cured for 24 hours at 80° C. The resulting cured elastomer had a Shore A hardness of 81 and a filler content of 17.5 wt %. The sixteen molded elements 10 were assembled to form the test body 19 as represented in FIG. 2, and ground to a diameter of 31.8 mm. The assembled and ground test body was tested against a polyester screen following the standard AT 2000 test procedure. Wear of the polyester screen 15 was determined by the weight difference of two punched-out circular samples (diameter of 23 mm), of which one was inside the wear area and the other outside the wear area.

Table 1 below gives the weight loss of the punched-out samples from tests performed with different pigment slurry concentrations, compared to results obtained under identical test conditions for two reference test bodies with cover materials of conventional aluminum oxide ceramic and silicon carbide.

TABLE 1

| Cover material | Slurry pigment (OMYA) | Pigment conc. [%] | Weight loss [mg] |
|---|---|---|---|
| PUR/PTFE 81A | HC 50-BG | 0.8 | 0.5 |
| PUR/PTFE 81A | HC 50-BG | 1.6 | 0.2 |
| PUR/PTFE 81A | HC 50-BG | 2.4 | 0.3 |
| PUR/PTFE 81A | HC 50-BG | 3.2 | 0.5 |
| $Al_2O_3$ | HC 50-BG | 0.8 | 16.5 |
| $Al_2O_3$ | HC 50-BG | 1.4 | 51.4 |
| SiC | HC 50-BG | 0.8 | 1.0 |
| SiC | HC 50-BG | 1.6 | 1.8 |
| SiC | HC 50-BG | 2.4 | 2.8 |
| SiC | HC 50-BG | 3.2 | 3.1 |

Table 1 shows a drastic wear reduction of the polyester screen when using a PTFE filled material according to the present invention, relative to both $Al_2O_3$ and SiC used under identical conditions.

Example 2

This example relates to the preparation and testing of a PTFE-filled cast polyurethane (PUR) body having a higher Shore A hardness than the test body of Example 1 above.

To prepare the material, 44.09 g of the same initial Polyol/PTFE dispersion as in Example 1 was degassed and mixed with 35.11 g of degassed prepolymer (Hyperplast100) and 2.49 g of chain extender 1,4-butanediol (Merck) for two minutes and molded into sixteen elements (one of which is detailed in FIG. 1) using a silicone mold, and then cured for 24 hours at 80° C. The resulting cured elastomer had a Shore A hardness of 86 and a filler content of 16.2 wt %. The sixteen molded elements were assembled to form the test body as represented in FIG. 2, and ground to a diameter of 31.8 mm. The assembled and ground test body was tested against a polyester screen following the standard AT 2000 test procedure. Wear of the polyester screen was determined by the weight difference of two punched-out circular samples (diameter of 23 mm) of which one was inside the wear area and the other outside the wear area.

Table 2 gives the weight loss of the punched-out samples from tests performed with different pigment slurry concentrations, compared to results obtained under identical test conditions for two reference test bodies with cover materials of conventional aluminum oxide ceramic and silicon carbide.

TABLE 2

| Cover material | Slurry pigment (OMYA) | Pigment conc. [%] | Weight loss [mg] |
|---|---|---|---|
| PUR/PTFE 86A | HC 50-BG | 0.8 | 1.2 |
| PUR/PTFE 86A | HC 50-BG | 1.6 | 2.4 |
| PUR/PTFE 86A | HC 50-BG | 2.4 | 4.1 |
| PUR/PTFE 86A | HC 50-BG | 3.2 | 5.2 |
| $Al_2O_3$ | HC 50-BG | 0.8 | 16.5 |
| $Al_2O_3$ | HC 50-BG | 1.4 | 51.4 |
| SiC | HC 50-BG | 0.8 | 1.0 |
| SiC | HC 50-BG | 1.6 | 1.8 |
| SiC | HC 50-BG | 2.4 | 2.8 |
| SiC | HC 50-BG | 3.2 | 3.1 |

Table 2 shows the effect of increased hardness of the PFTE filled material. The wear reduction of the polyester screen is still very important compared to the $Al_2O_3$ ceramic, but the wear is slightly higher when compared to the SiC.

Example 3

This example relates to the preparation and testing of a PTFE-filled cast polyurethane (PUR) body having a lower Shore A hardness than the test body of Example 1 above.

To prepare the material, 48.32 g of the same initial Polyol/PTFE dispersion as in Example 1 was degassed and mixed with 29.13 g of degassed prepolymer (Hyperplast100) and 1.14 g of chain extender 1,4-butanediol (Merck) for two minutes and molded into sixteen elements (one of which is detailed in FIG. 1) using a silicone mold, and then cured for 24 hours at 80° C. The resulting cured elastomer had a Shore A hardness of 78 and a filler content of 18.5 wt %. The sixteen molded elements were assembled to form the test body as represented in FIG. 2, and ground to a diameter of 31.8 mm. The assembled and ground test body was tested against a polyester screen following the standard AT 2000 test procedure. Wear of the polyester screen was determined by the weight difference of two punched-out circular samples (diameter of 23 mm) of which one was inside the wear area and the other outside the wear area.

Table 3 gives the weight loss of the punched-out samples from tests performed with different pigment slurry concentrations, compared to results obtained under identical test conditions for two reference test bodies with cover materials of conventional aluminum oxide ceramic and silicon carbide.

TABLE 3

| Cover material | Slurry pigment (OMYA) | Pigment conc. [%] | Weight loss [mg] |
|---|---|---|---|
| PUR/PTFE 78A | HC 50-BG | 0.8 | 0.2 |
| PUR/PTFE 78A | HC 50-BG | 1.6 | 0.5 |
| PUR/PTFE 78A | HC 50-BG | 2.4 | 1.9 |
| $Al_2O_3$ | HC 50-BG | 0.8 | 16.5 |
| $Al_2O_3$ | HC 50-BG | 1.4 | 51.4 |
| SiC | HC 50-BG | 0.8 | 1.0 |
| SiC | HC 50-BG | 1.6 | 1.8 |
| SiC | HC 50-BG | 2.4 | 2.8 |

Table 3 shows the effect of decreased hardness of the PFTE filled material. The wear reduction of the polyester screen is very significant relative to both $Al_2O_3$ and SiC.

Example 4

This example relates to the preparation and testing of a test body comprised of a talcum-filled cast polyurethane (PUR) matrix.

To prepare the material, 129.05 g of cosmetic grade talc powder was dispersed at room temperature in 300 g of a polyol ("Hyperplast 2851024", from Hyperplast) with 0.58 g Byk W 968 (wetting and dispersing additive) and 0.58 g Byk A 555 (air release additive). An amount of 67.28 g of this dispersion was degassed and mixed with 45.73 g of degassed prepolymer (Hyperplast100) and 2.47 g of chain extender 1,4-butanediol (Merck) for two minutes and molded into sixteen elements (one of which is detailed in FIG. 1) using a silicone mold, and then cured for 24 hours at 80° C. The resulting cured elastomer had a Shore A hardness of 80 and a filler content of 17.5 wt %. The sixteen molded elements were assembled to form the test body as represented in FIG. 2, and ground to a diameter of 31.8 mm. The assembled and ground test body was tested against a polyester screen following the standard AT 2000 test procedure. Wear of the polyester screen was determined by the weight difference of two punched-out circular samples (diameter of 23 mm) of which one was inside the wear area and the other outside the wear area.

Table 4 gives the weight loss of the punched-out samples from tests performed with different pigment slurry concentrations, compared to results obtained under identical test conditions for two reference test bodies with cover materials of conventional aluminum oxide ceramic and silicon carbide.

TABLE 4

| Cover material | Slurry pigment (OMYA) | Pigment conc. [%] | Weight loss [mg] |
|---|---|---|---|
| PUR/Talc 80A | HC 50-BG | 0.8 | 0.8 |
| PUR/Talc 80A | HC 50-BG | 1.6 | 1.5 |
| PUR/Talc 80A | HC 50-BG | 2.4 | 2.0 |
| PUR/Talc 80A | HC 50-BG | 3.2 | 2.3 |
| $Al_2O_3$ | HC 50-BG | 0.8 | 16.5 |
| $Al_2O_3$ | HC 50-BG | 1.4 | 51.4 |
| SiC | HC 50-BG | 0.8 | 1.0 |
| SiC | HC 50-BG | 1.6 | 1.8 |
| SiC | HC 50-BG | 2.4 | 2.8 |
| SiC | HC 50-BG | 3.2 | 3.1 |

Table 4 shows the effect of a low hardness filler. (Moh's hardness between 1 and 5) having a high aspect ratio. The wear reduction of the polyester screen is significant relative to both $Al_2O_3$ and SiC.

Example 5

This example relates to the preparation and testing of a test body comprised of a calcium carbonate-filled cast polyurethane (PUR) matrix.

To prepare the material, 250 g of calcium carbonate powder ("HC 50-BG", from OMYA) was dispersed at room temperature in 300 g of a polyol ("Hyperplast 2851024", from Hyperplast) with 0.3 g Byk W 968 (wetting and dispersing additive), 0.3 g Byk A 555 (air release additive) and 0.3 g of Byk 088 (defoamer additive). An amount of 87.77 g of this dispersion was degassed and mixed with 41.17 g of degassed prepolymer (Hyperplast100) and 1.61 g of chain extender 1,4-butanediol (Merck) for two minutes and molded into sixteen elements (one of which is detailed in FIG. 1) using a silicone mold, and then cured for 24 hours at 80° C. The resulting cured elastomer had a Shore A hardness of 82 and a filler content of 30.5 wt %. The sixteen molded elements were assembled to form the test body as represented in FIG. 2, and ground to a diameter of 31.8 mm. The assembled and ground test body was tested against a polyester screen following the standard AT 2000 test procedure. Wear of the polyester screen was determined by the weight difference of two punched-out circular samples (diameter of 23 mm) of which one was inside the wear area and the other outside the wear area.

Table 5 gives the weight loss of the punched-out samples from tests performed with different pigment slurry concentrations, compared to results obtained under identical test conditions for two reference test bodies with cover materials of conventional aluminum oxide ceramic and silicon carbide.

TABLE 5

| Cover material | Slurry pigment (OMYA) | Pigment conc. [%] | Weight loss [mg] |
|---|---|---|---|
| PUR/$CaCO_3$ 82A | HC 50-BG | 0.8 | 2.5 |
| PUR/$CaCO_3$ 82A | HC 50-BG | 1.6 | 4.3 |
| PUR/$CaCO_3$ 82A | HC 50-BG | 2.4 | 5.8 |
| PUR/$CaCO_3$ 82A | HC 50-BG | 3.2 | 8.5 |
| $Al_2O_3$ | HC 50-BG | 0.8 | 16.5 |
| $Al_2O_3$ | HC 50-BG | 1.4 | 51.4 |
| SiC | HC 50-BG | 0.8 | 1.0 |
| SiC | HC 50-BG | 1.6 | 1.8 |
| SiC | HC 50-BG | 2.4 | 2.8 |
| SiC | HC 50-BG | 3.2 | 3.1 |

Table 5 shows the effect of a low hardness filler having a low aspect ratio. The wear reduction of the polyester screen is still very important compared to the $Al_2O_3$ ceramic, but the wear is slightly higher when compared to the SiC.

Example 6

This example relates to the preparation and testing of a test body comprised of a hexagonal boron nitride-filled (BN) cast polyurethane (PUR) matrix.

To prepare the material, 129 g of BN powder ("AC 6004", from Advanced Ceramics) was dispersed at room temperature in 300 g of a polyol ("Hyperplast 2851024", from Hyperplast) with 0.5 g Byk W 968 (wetting and dispersing additive) and 0.5 g Byk A 555 (air release additive). An amount of 70.71 g of this dispersion was degassed and mixed with 48.08 g of degassed prepolymer (Hyperplast100) and 2.60 g of chain extender 1,4-butanediol (Merck) for two minutes and molded into sixteen elements (one of which is detailed in FIG. 1) using a silicone mold, and then cured for 24 hours at 80° C. The resulting cured elastomer had a Shore A hardness of 84 and a filler content of 17.5 wt %. The sixteen molded elements were assembled to form the test body as represented in FIG. 2, and ground to a diameter of 31.8 mm. The assembled and ground test body was tested against a polyester screen following the standard AT 2000 test procedure. Wear of the polyester screen was determined by the weight difference of two punched-out circular samples (diameter of 23 mm) of which one was inside the wear area and the other outside the wear area.

Table 6 gives the weight loss of the punched-out samples from tests performed with different pigment slurry concentrations, compared to results obtained under identical test conditions for two reference test bodies with cover materials of conventional aluminum oxide ceramic and silicon carbide.

TABLE 6

| Cover material | Slurry pigment (OMYA) | Pigment conc. [%] | Weight loss [mg] |
|---|---|---|---|
| PUR/BN 84A | HC 50-BG | 0.8 | 4.2 |
| PUR/BN 84A | HC 50-BG | 1.6 | 6.0 |
| PUR/BN 84A | HC 50-BG | 2.4 | 8.6 |
| PUR/BN 84A | HC 50-BG | 3.2 | 10.2 |
| $Al_2O_3$ | HC 50-BG | 0.8 | 16.5 |
| $Al_2O_3$ | HC 50-BG | 1.4 | 51.4 |
| SiC | HC 50-BG | 0.8 | 1.0 |
| SiC | HC 50-BG | 1.6 | 1.8 |
| SiC | HC 50-BG | 2.4 | 2.8 |
| SiC | HC 50-BG | 3.2 | 3.1 |

Table 6 shows the effect of a solid lubricant filler having a high aspect ratio. The wear reduction of the polyester screen is still very important compared to the $Al_2O_3$ ceramic, but the wear is higher when compared to the SiC.

To conclude, an alternative to prior art hard ceramic materials for dewatering elements at the wet end of paper-making machines has been proposed and described. The inventive material is a soft elastomeric material having a hardness according to Shore A of between 60 and 85. The material contains a filler at a level of about 10 to 50 wt %.

Preferably, the filler is a low hardness and/or solid lubricant filler. The effect of a filler of low/high aspect ratio has been demonstrated. The aspect ratio is used for characterizing the shape of the filler, and corresponds to the ratio of length to thickness. Spherical or near spherical particles will have no or a very low aspect ratio, while platelets, flakes or fibers will have a high aspect ratio. The aspect ratio has an important influence on certain properties of the composite, such as reinforcement etc. Among the fillers mentioned above, calcium carbonate and PTFE have a low aspect ratio, whereas boron nitride and talc have a much higher aspect ratio. Solid lubricants are solid particles used for reducing friction, increase load carrying capability, provide boundary lubrication, reduce wear, etc. Typical solid lubricants are graphite, molybdenum disulfide, PTFE and boron nitride.

Hence, the present invention completely eliminates the need for the vulnerable ceramic materials that have been used in the prior art. At the same time, wear on the forming screen in the paper-making machine is kept very low, thus making replacement of the forming screen less frequently needed. The material according to the present invention can be provided on the surfaces of dewatering elements. In some cases, it may even be possible to prepare dewatering elements more or less entirely from the inventive material. The examples have shown that the wear on the forming screen, when using the material according to the present invention for the dewatering elements, is indeed very low. It is envisaged that competitive and commercially successful dewatering elements will be prepared with the inventive material.

The invention claimed is:

1. A dewatering element for the wet end of a paper-making machine, said dewatering element having a sliding surface for contacting a forming screen, said sliding surface being made from a material that comprises an elastomeric polymer matrix and a filler which is a low hardness filler having a hardiness on Moh's scale between 1 and 5 and/or a solid lubricant filler, wherein said filler is added to said matrix at a level of 10 to 50 percent by weight, wherein the material has a hardness according to Shore A between 60 and 85.

2. The dewatering element of claim 1, wherein said elastomeric polymer matrix comprises a material selected from polyurethane, polyurea, styrene-butadiene rubber, ethylene propylene diene monomer (EPDM), nitrile rubber, natural or synthetic rubbers, polychloroprene, polyacrylates, fluorine-containing elastomers, theromoplastic elastomer, and polysiloxanes.

3. The dewatering element of claim 2, wherein the polymer matrix comprises polyurethane.

4. The dewatering element of claim 1, wherein the filler is a low hardness filler having a hardness on Moh's scale between 1 and 5.

5. The dewatering element of claim 1, wherein the filler is a solid lubricant.

6. The dewatering element of claim 1, wherein the filler comprises a material selected from poly(tetrafluoroethylene), talcum, powders of ultra high molecular weight polyethylene (UHMWPE), clay (kaolin), calcium carbonate, boron nitride, molybdenum sulfide, calcium fluoride, titanium dioxide, titanium carbide, glass beads, and ceramic beads.

7. The dewatering element of claim 1, wherein the filler is selected from poly(tetrafluoroethylene), and talcum.

8. The dewatering element of claim 1, wherein the filler is added at a level of 10 to 40 percent by weight.

9. The dewatering element of claim 1, wherein the material for the sliding surface has a hardness according to Shore A between 70 and 80.

10. The dewatering element of claim 1, wherein the filler is added at a level of 15 to 30 percent by weight.

11. The dewatering element of claim 2, wherein the filler is added at a level of 10 to 40 percent by weight.

12. The dewatering element of claim 3, wherein the filler is added at a level of 10 to 40 percent by weight.

13. The dewatering element of claim 4, wherein the filler is added at a level of 10 to 40 percent by weight.

14. The dewatering element of claim 5, wherein the filler is added at a level of 10 to 40 percent by weight.

15. The dewatering element of claim 2, wherein the material for the sliding surface has a hardness according to Shore A between 70 and 80.

16. The dewatering element of claim 3, wherein the material for the sliding surface has a hardness according to Shore A between 70 and 80.

17. The dewatering element of claim 4, wherein the material for the sliding surface has a hardness according to Shore A between 70 and 80.

18. The dewatering element of claim 5, wherein the material for the sliding surface has a hardness according to Shore A between 70 and 80.

19. The dewatering element of claim 2, wherein the filler is added at a level of 15 to 30 percent by weight.

20. The dewatering element of claim 3, wherein the filler is added at a level of 15 to 30 percent by weight.

* * * * *